US009223254B2

(12) United States Patent
Abe et al.

(10) Patent No.: US 9,223,254 B2
(45) Date of Patent: Dec. 29, 2015

(54) IMAGE FORMING APPARATUS

(71) Applicant: CANON KABUSHIKI KAISHA, Tokyo (JP)

(72) Inventors: Keisuke Abe, Yokohama (JP); Kazuhisa Kemmochi, Suntou-gun (JP); Hayato Ida, Yokohama (JP); Takashi Hirasa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/156,556

(22) Filed: Jan. 16, 2014

(65) Prior Publication Data

US 2014/0205330 A1 Jul. 24, 2014

(30) Foreign Application Priority Data

Jan. 22, 2013 (JP) ..... 2013-008982

(51) Int. Cl.

*G03G 15/24* (2006.01)
*G03G 15/20* (2006.01)
*G03G 15/16* (2006.01)

(52) U.S. Cl.

CPC ..... *G03G 15/161* (2013.01); *G03G 15/2017* (2013.01); *G03G 15/24* (2013.01); *G03G 15/206* (2013.01); *G03G 2215/0129* (2013.01); *G03G 2215/1695* (2013.01)

(58) Field of Classification Search

CPC ..... G03G 2215/1695
USPC ..... 399/307, 340
See application file for complete search history.

(56) References Cited

U.S. PATENT DOCUMENTS

| | | | | |
|---|---|---|---|---|
| 7,206,541 | B2 | 4/2007 | Fukita et al. | |
| 7,224,922 | B2 | 5/2007 | Kemmochi | |
| 7,233,762 | B2 | 6/2007 | Kunii et al. | |
| 7,630,677 | B2 | 12/2009 | Osada et al. | |
| 7,697,877 | B2 | 4/2010 | Asakura et al. | |
| 7,725,068 | B2 * | 5/2010 | Matsunaka et al. | 399/333 |
| 7,809,317 | B2 * | 10/2010 | Someya et al. | 399/307 |
| 8,351,837 | B2 | 1/2013 | Kitano et al. | |

(Continued)

FOREIGN PATENT DOCUMENTS

| | | | |
|---|---|---|---|
| JP | 2001-272866 | A | 10/2001 |
| JP | 2005-266304 | A | 9/2005 |

(Continued)

OTHER PUBLICATIONS

U.S. Appl. No. 14/152,387, filed Jan. 10, 2014 to Tsutomu Miki et al.

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

An image forming apparatus is configured to form a toner image by a toner image forming portion on an intermediate transfer belt, to transfer the toner image to a transfer and fixing belt, and to form a toner film by heating and pressurizing the toner image on the transfer and fixing belt. The transfer and fixing belt includes an elastic layer and when the toner film is pressurized to a recording medium in a body at a toner film transfer portion, the toner film is pressed to the recording medium while following surficial ruggedness of the recording medium. Because the toner image is formed by using toner particles containing a thermoplastic elastomer having crystallinity, the toner film formed of this toner image is fully resilient.

7 Claims, 12 Drawing Sheets

(56) References Cited

U.S. PATENT DOCUMENTS

| | | | | |
|---|---|---|---|---|
| 8,364,067 | B2 | 1/2013 | Miki et al. | |
| 2005/0207801 | A1 | 9/2005 | Kunii et al. | |
| 2006/0133863 | A1 | 6/2006 | Asakura et al. | |
| 2009/0181317 | A1 * | 7/2009 | Moriya | 430/109.4 |
| 2011/0103808 | A1 | 5/2011 | Abe et al. | |
| 2011/0103809 | A1 | 5/2011 | Kuwata et al. | |
| 2011/0318036 | A1 | 12/2011 | Abe et al. | |
| 2012/0251168 | A1 * | 10/2012 | Nagayama et al. | 399/111 |
| 2013/0302731 | A1 * | 11/2013 | Ida et al. | 430/109.4 |

FOREIGN PATENT DOCUMENTS

| | | | |
|---|---|---|---|
| JP | 2006-195429 | A | 7/2006 |
| WO | WO 2012091148 | A1 * | 7/2012 |

* cited by examiner

IMAGE FORMING APPARATUS

BACKGROUND OF THE INVENTION

1. Field of the Invention

The present invention relates to an image forming apparatus configured to transfer a toner film formed on a transfer and fixing belt to a recording medium.

2. Description of the Related Art

A simultaneous transfer and fixing type image forming apparatus is being put into practical use lately. The image forming apparatus is configured to transfer a toner image formed on an image carrier to an intermediate transfer belt and to fix the toner image on the intermediate transfer belt to a recording medium by overlapping and by heating and pressing them together as disclosed in Japanese Patent Application Laid-open No. 2001-272866 for example. However, because the simultaneous transfer and fixing type image forming apparatus has a possibility of causing unevenness of density on an image due to melt toner that flows into concavities on a surface of the recording medium, there is proposed a toner film transfer type image forming apparatus configured to form a toner film and to transfer this toner film to a recording medium.

Specifically, Japanese Patent Application Laid-open No. 2005-266304 discloses a method including processes of forming a toner film by heating and pressing a toner image carried on a transfer and fixing belt, overlapping a recording medium with the toner film in which a melt layer has been formed by heating a surface thereof, and pressing them together to thermally bond the toner film on the recording medium. Japanese Patent Application Laid-open No. 2006-195429 also discloses a method including processes of forming a toner film by heating and pressing a toner film carried on a transfer and fixing belt, overlapping a recording medium with the toner film in which a bond layer has been formed by applying solvent, and pressing together to physically bond the toner film on the recording medium.

By the way, it is demanded lately to be able to form an image on a recording medium such as a recycled sheet, a thick sheet and an embossed sheet whose superficial ruggedness (roughness) is large. In case of the recording medium whose superficial ruggedness is large, the simultaneous transfer and fixing type image forming apparatus causes unevenness of density and lowers its image quality as described above. Meanwhile, Japanese Patent Application Laid-open Nos. 2001-272866 and 2006-195429 also have a possibility that the toner film does not fully adhere down to bottoms of concavities and separate from the recording medium, thus dropping strength of the image. There is also a possibility that the toner film cracks everywhere on the surface of the recording medium where there exist concavities and the image quality drops as well if the toner film is tried to be adhered down to the bottoms of the concavities from an aspect of intensity of the image.

SUMMARY OF THE INVENTION

According to an aspect of the present invention, an image forming apparatus includes an intermediate transfer belt, a toner image forming portion configured to form a toner image on the intermediate transfer belt by using toner particles each containing a binder and a thermoplastic elastomer having crystallinity, a transfer and fixing belt having an elastic layer and to which the toner image formed on the intermediate transfer belt is transferred, a pressurizing and heating portion configured to form a toner film by heating the toner image carried by the transfer and fixing belt to a temperature of a softening temperature or more of the toner particles in a pressurized condition and a toner film transfer portion configured to press the toner film formed by the pressurizing and heating portion on the transfer and fixing belt together with a recording medium to transfer the toner film to the recording medium.

Further features of the present invention will become apparent from the following description of exemplary embodiments with reference to the attached drawings.

DESCRIPTION OF THE EMBODIMENTS

Preferred embodiments of the present invention will be described in detail below with reference to the drawings.

First Embodiment

Figure 1:
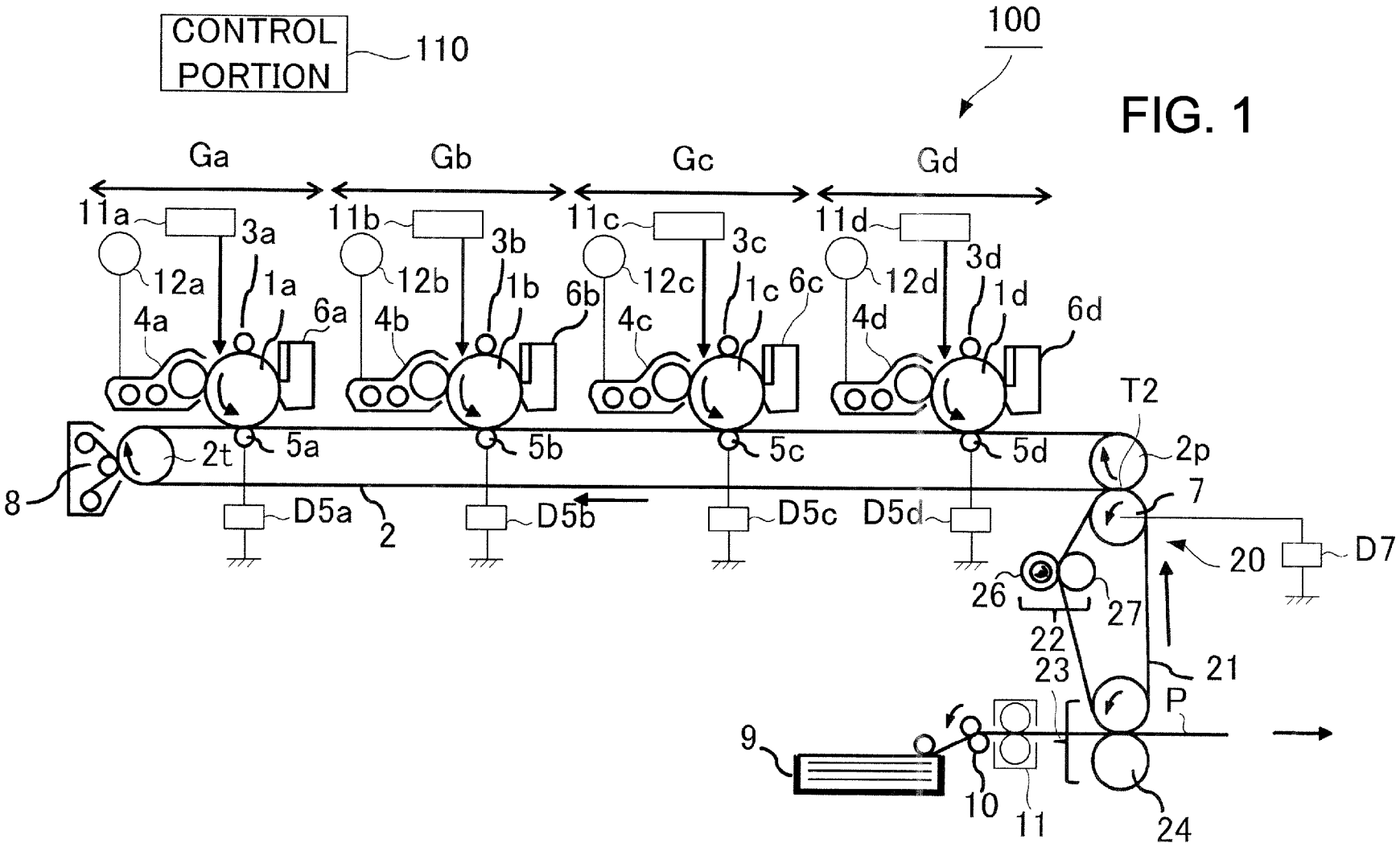
FIG. 1 is a schematic diagram illustrating a configuration of an image forming apparatus in accordance with a first embodiment.

As shown in FIG. 1, an image forming portion Ga which is one exemplary toner image forming portion and an intermediate transfer belt 2 are configured to form a toner image by using a toner including toner particles each of which contains a binder resin and a thermoplastic elastomer having crystallinity and to transfer the toner image to a transfer and fixing belt 21. The binder resin is a polyester resin, and the thermoplastic elastomer is a urethane-based thermoplastic elastomer.

Figure 2:
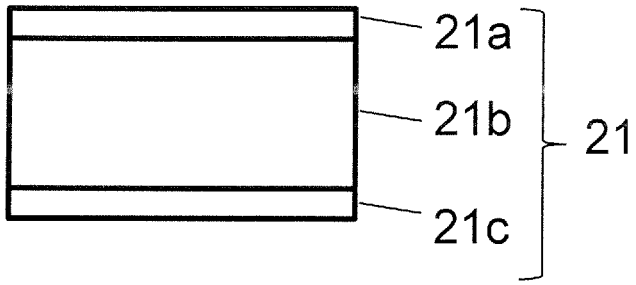
FIG. 2 schematically illustrates a configuration of a part of a transfer and fixing belt.

As shown in FIG. 2, the transfer and fixing belt which is one exemplary intermediate transfer body includes an elastic layer 21*b*. MD-1 hardness of a surface of the transfer and fixing belt 21 is in a range greater than or equal to 50 and less than 80. A recording medium heating unit 11 which is one exemplary recording medium heating portion heats up a recording medium to be sent to a film transfer portion 23 at a temperature less than a softening temperature of the toner. A reason why the temperature of the recording medium is set to be lower than the softening temperature of the toner is that the temperature of the recording medium may be possibly increased to be higher than a glass transition temperature in order to improve transferability of the toner film. However, it is conceivable to lower power saving performance and to cause a trouble such as fading of the sheet if the temperature of the recording medium is too high. It is also conceivable to damage the toner film if the recording medium is heated to a temperature higher than the softening temperature of the toner because the toner film may be heated up excessively when the toner film comes into contact with the recording medium in transferring the toner film to the recording medium. From the aspects described above, the toner softening temperature (about 115° C. by toner used in the verification) is considered to be an adequate value as an upper limit value of the temperature of the recording medium (glass transition temperature<flow starting temperature<softening temperature).

Figure 3:
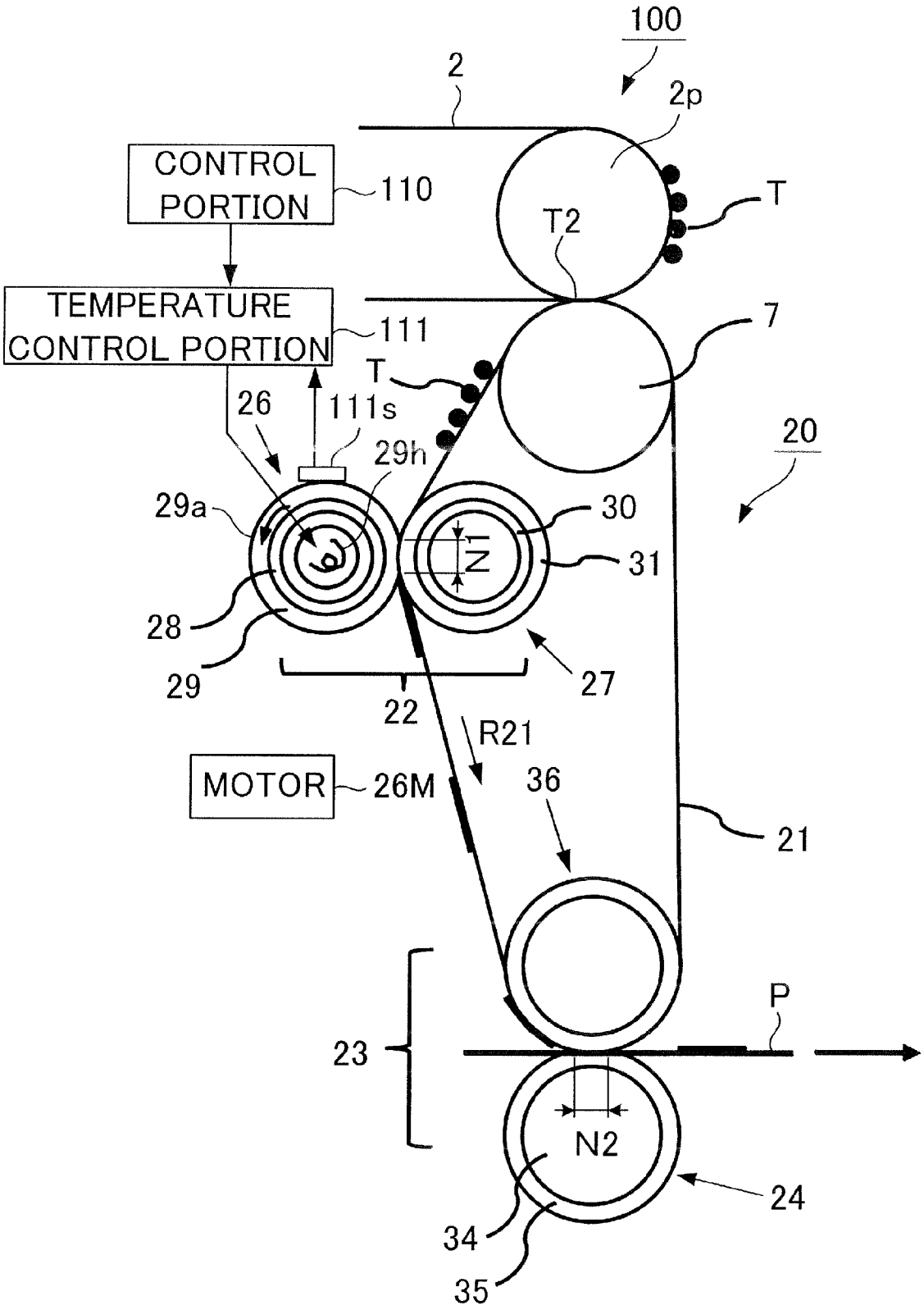
FIG. 3 is a schematic diagram illustrating a configuration of a transfer and fixing device.

As shown in FIG. 3, a film forming portion 22 which is one exemplary pressing and heating portion is configured to form the toner film by heating the toner image transferred from the intermediate transfer belt 2 to the transfer and fixing belt 21 at a temperature higher than or equal to the softening temperature of the toner under a pressurized condition. A film transfer portion 23 which is one exemplary toner film transfer portion is configured to press the toner film formed by the film forming portion 22 on the transfer and fixing belt 21 and the recording medium in a body to transfer the toner film to the recording medium.

(Image Forming Apparatus)

The first embodiment of the present invention will be described more specifically. FIG. 1 is a schematic diagram illustrating a configuration of the image forming apparatus 100 of the first embodiment. The image forming apparatus 100 is a tandem intermediary transfer type full-color printer in which image forming portions Ga, Gb, Gc and Gd of cyan, magenta, yellow and black are arrayed along the intermediate transfer belt 2.

The image forming portion Ga is configured to form a cyan toner image and to transfer it to the intermediate transfer belt 2. The image forming portion Gb is configured to form a magenta toner image and to transfer it to the intermediate transfer belt 2. The image forming portions Gc and Gd are configured to form yellow and black toner images and to transfer them to the intermediate transfer belt 2, respectively.

The four-color toner image transferred to and superimposed on the intermediate transfer belt 2 is conveyed to a secondary transfer portion T2 to be transferred to the transfer and fixing belt 21. The four-color toner image transferred to the transfer and fixing belt 21 is processed as a toner film pasted to the transfer and fixing belt 21 by receiving heat and pressure in the process of passing through the film forming portion 22, and is sent to the film transfer portion 23.

Meanwhile, a recording medium P is taken out of a recording medium cassette 9 one by one and is sent to the film transfer portion 23 by a registration roller 10. The film transfer portion 23 is configured to transfer the toner film onto the recording medium P by overlapping the recording medium P on the toner film on the transfer and fixing belt 21 and by conveying them in the pressurized condition. The toner film on the transfer and fixing belt 21 is conveyed to the film transfer portion 23 and is transferred onto the recording medium P.

(Recording Medium Heating Unit)

It is necessary to keep the toner film in a heated condition by a certain degree in order to give the toner film with viscosity to transfer the toner film onto the recording medium. That is, it becomes possible to transfer and fix the toner film by lowering viscosity of the toner resin and causing adhesiveness by keeping the toner film in the heated condition.

A recording medium heating unit 11 is disposed downstream in a sheet conveying direction of the registration roller 10 and heats up the recording medium between the registration roller 10 and the film transfer portion 23. The recording medium heating unit 11 is composed of a heating roller pair containing a halogen heater. However, it is also possible to arrange such that a heating unit such as a non-contact radiation heater is disposed on a conveying path of the recording medium.

In thermally transferring the toner film, such a possibility that the toner film is damaged on the transfer and fixing belt 21 increases if the temperature is set too high, and required fixing strength cannot be obtained if the temperature is too low. Due to that, while it is necessary to control the temperature of the toner film within a narrow temperature range, thermal capacity, moisture-absorption characteristics and temperature of the recording medium may turn out to be great disturbance factors in such a case. It is then effective to increase the temperature of the recording medium to several tens degrees at this time because it is possible to reduce such disturbances, to enhance wettability of the toner film to the recording medium, and to lower the temperature of the toner film required for the transfer thereof. The recording medium heating unit 11 allows an output image having a high image quality to be output with stable fixing strength by heating the recording medium preliminarily such that superficial temperature of the recording medium in entering a film transfer nip portion becomes 60 to 70° C.

(Image Forming Portion)

The image forming portions Ga, Gb, Gc and Gd are configured in the same manner except that the colors of the toners used in developing units 4*a*, 4*b*, 4*c* and 4*d* are different. Accordingly, only the image forming portion Ga will be described below and an overlapped explanation concerning the image forming portions Gb, Gc and Gd will be omitted here. It is noted that in the present embodiment, the yellow color toner is used in the developing unit 4*a*, the magenta color toner is used in the developing unit 4*b*, the cyan color toner is used in the developing unit 4*c*, and the black color toner is used in the developing unit 4*d*.

The image forming portion Ga includes a charging roller 3*a*, an exposure unit 11*a*, a developing unit 4*a*, a primary transfer roller 5*a*, and a drum cleaning unit 6*a* disposed around a photoconductive drum 1*a*. The photoconductive drum 1*a* is what a photoconductive thin film whose charge polarity is negative is formed around a peripheral surface of a base body made of aluminum and rotates at a processing speed of 100 mm/sec. The charging roller 3*a* is applied with vibration voltage in which AC voltage is superimposed on DC voltage and charges the peripheral surface of the photoconductive drum 1*a* with a homogeneous negative potential.

The exposure unit 11*a* is configured to form an electrostatic image of the image by scanning a laser beam binary-modulated corresponding to an image signal of a scan line to the peripheral surface of the photoconductive drum 1*a*. The developing unit 4*a* is configured to develop the electrostatic image by using a two-component developer containing toner and carrier and to form a toner image on the photoconductive drum 1*a*.

The primary transfer roller 5*a* is applied with positive DC voltage and transfers the toner image on the photoconductive drum 1*a* to the intermediate transfer belt 2. The drum cleaning unit 6*a* is configured to recover remaining toner in the transfer operation by bringing a cleaning blade into contact with the photoconductive drum 1*a*.

(Developer Supplying Portion)

The developing unit 4*a* agitates the two-component developer containing the toner and the carrier to triboelectrify the toner and the carrier. The toner is carried on the developer carrier as the positively triboelectrified carrier is magnetically bound by the developer carrier and forms magnetic bristles and the negatively triboelectrified toner is elecrostatically bound by the carrier. The developing unit 4*a* develops the electrositatic image on the photoconductive drum 1*a* as a toner image by bringing the magnetic bristles of the carrier in slidable contact with the photoconductive drum 1*a*. The toner is consumed every time when an image is formed, so that developer to be replenished is supplied from a developer container 12*a* to replenish the consumption.

The developer to be replenished and having a rate of content of toner higher than that of the two-component developer in the developing unit 4*a* is filled in the developer container 12*a*. When the replenished developer in the developer container 12*a* depletes, the empty developer container 12*a* is replaced with a new developer container 12*a* in which new developer to be replenished is filled.

(Secondary Transfer Portion)

A secondary transfer roller 7 is arranged to nip the intermediate transfer belt 2 and the transfer and fixing belt 21 between the roller 7 and a drive roller 2*p* and to form a secondary transfer portion T2 of the toner image between the intermediate transfer belt 2 and the transfer and fixing belt 21.

A power supply D7 applies DC voltage to the secondary transfer roller 7 to electrically transfer the toner image carried on the intermediate transfer belt 2 to the transfer and fixing belt 21.

A belt cleaning unit 8 is configured such that a nonwoven cleaning web comes into slidable contact with the surface of the intermediate transfer belt 2 to recover transfer residual toner and other debris remaining on the intermediate transfer belt 2.

(Transfer Fixing Belt)

FIG. 2 schematically illustrates a configuration of a part of the transfer and fixing belt 21. As shown in FIG. 2, the transfer and fixing belt 21 is formed by forming an elastic layer 21*b* of 1 mm thick and made of silicon rubber on a polyimide base layer 21*c* of 100 μm thickness and by coating a surface of the elastic layer 21*b* by a fluororesin (PTFE) release layer 21*a* of 30 μm thick.

The base layer 21*c* is preferably made of a heat resistant and strong material. The elastic layer 21*b* is preferable to be a fully soft and heat resistant elastic material so that the transfer and fixing belt 21 can fully follow superficial ruggedness of the recording medium. The release layer 21*a* is preferably made of a releasable material in order to transfer the toner film from the transfer and fixing belt 21 to the recording medium in the film transfer portion 23.

(Film Forming Portion)

FIG. 3 is a schematic diagram illustrating a configuration of a transfer and fixing unit 20. The transfer and fixing unit 20 is composed of the transfer and fixing belt 21 described above, a film forming portion 22, a film transfer portion 23, and others. When a toner loading amount is small, there exists a gap between toner particles of the non-fixed toner image on the transfer and fixing belt 21 as shown in FIG. 3. The film forming portion 22 applies enough heat and pressure to the toner image on the transfer and fixing belt 21 to melt the toner image and to fill the gaps between the toner particles to form a toner film. The film forming portion 22 includes a film forming heat roller 26 that is in pressure contact with the transfer and fixing belt 21 supported by a film forming pressure roller 27 and forms a film forming nip portion N.

The film forming heat roller 26 has an outer diameter of 30 mm and rotates by being driven by a motor 26M with 100 mm/sec of surface velocity to drive the transfer and fixing belt 21 in a direction of an arrow R21.

The film forming heat roller 26 includes an aluminum core metal 28 having 20 mm of outer diameter, a silicon rubber elastic layer 29 of 5 mm thick disposed around the core metal 28, and a release layer 29*a* of 30 μm thick made of a tube material of perfluoroalkoxy resin disposed around the elastic layer 29. While the release layer 29*a* may be what the tube material is coated or what paint is coated and sintered on the surface, the tube material is preferable because it excels in durability.

It is necessary to steadily keep the toner film nipped between the release layer of the film forming heat roller 26 and the release layer of the transfer and fixing belt 21 on the transfer and fixing belt 21 side and not to transfer to the film forming heat roller 26 in forming the film in the film forming portion 22. To that end, a fluororesin material whose releasing property to toner is higher than that of the release layer (PTFE) of the transfer and fixing belt 21 is adopted for the release layer 29*a* (PFA) of the film forming heat roller 26.

The film forming pressure roller 27 is pressurized by its both ends by a force of 600 N of total pressure by a pressurizing mechanism not shown and forms a film forming nip portion N1 of 10 mm long in the conveying direction. The film forming pressure roller 27 rotates by being driven by the film forming heat roller 26. A temperature control portion 111 controls ON/OFF of a heater 29*h* so that temperature sensed by a temperature sensor 111*s* reaches a predetermined target temperature.

The film forming pressure roller 27 has an outer diameter of 30 mm. The film forming pressure roller 27 includes a foam rubber elastic layer 31 of 4 mm thick formed around a core metal 30 made of iron and having an outer diameter of 22 mm. The film forming pressure roller 27 is constructed to have a low heat capacity and low heat conductivity so that the film forming pressure roller 27 does not seize heat applied from the film forming heat roller 26 to the toner image more than necessary. The film forming pressure roller 27 does not come into contact directly with toner, so that the film forming pressure roller 27 has no release layer on an outermost surface layer thereof.

The film forming nip portion N1 is configured to form a toner film by applying heat and pressure to the toner particles of the non-fixed toner image on the transfer and fixing belt 21. Appropriate preset temperature, preset pressure and time when the film forming portion 22 melts and films powder toner change depending on melting viscosity and viscoelastic property of toner to be used, a toner loading amount, hardness of the film forming heat roller 26 and the like, so that it is appropriate to preset them corresponding to the circumstance.

Toner of 6 μm of grain size and 1.2 g/cm$^3$ of specific weight may be used for example in the present embodiment. In case of using the image forming apparatus 100 under an image forming condition of 0.3 mg/cm$^2$ of maximum toner loading amount of single toner color, a toner image before forming a film to be formed by using the toner is in a condition less than a monolayer densest filling condition, so that a large number of gaps exist between the toner particles. Then, in order to form a toner film by filling the gaps between the toner particles and to consolidate them, a surface temperature of the film forming heat roller 26 is preset at 150° C., a pressurizing load at 600 N, and a film forming nip width N1 at 10 mm for example in the present embodiment. It is noted that these values are merely exemplary values and should not be construed to limit film forming conditions of the invention.

(Film Transfer Portion)

The film transfer portion 23 includes a film transfer roller 24 that is in pressure contact with the transfer and fixing belt 21 whose inner side surface is supported by a stretch roller 36, and forms a film transferring nip portion N2 between the film transfer roller and the transfer and fixing belt 21. The recording medium P is overlapped with the toner film on the transfer and fixing belt 21 and a pressure is applied in the film transferring nip portion N2 to transfer and fix the toner film from the transfer and fixing belt 21 to the recording medium P.

A pressure mechanism not shown presses both end portions of the film transfer roller 24 toward the stretch roller 36 with a force of total pressure of 450 N, so that the film transferring nip portion N2 of 10 mm in length in the conveying direction is formed. The film transfer roller 24 rotates by being driven by the transfer and fixing belt 21.

The film transfer roller 24 and the stretch roller 36 are constructed in the same manner. The film transfer roller 24 has an outer diameter of 44 mm. The film transfer roller 24 is composed of a core metal 34 made of aluminum and 40 mm in outer diameter and an elastic layer 35 made of silicon rubber, 2 mm thick and disposed around the core metal 34. No release layer is provided around a peripheral surface of the film transfer roller 24 to realize high conveying performance by gripping the recording medium P with an adequate friction force.

(Toner)

The toner used in the present embodiment contains a binder resin and a thermoplastic elastomer. An arbitrary resin may be used as the binder resin as long as it is compatible with the thermoplastic elastomer. Specifically, polyester resin which excels in strength even though its molecular weight is low is preferable as the binder resin.

The used in the present embodiment has crystallinity derived from the thermoplastic elastomer. That is, the thermoplastic elastomer contained in the toner is crystalline thermoplastic elastomer. The crystalline thermoplastic elastomer has crystal portions (hard segment) and non-crystal portions (soft segment) softer than the crystal portions, and cross-links with the crystal portions. Therefore, the crystal portions are loosened and viscosity of the crystalline thermoplastic elastomer drops in high temperature. A degree of crystallization of the crystallity is preferable to be 1% or more and 50% or less, or is more preferable to be 3% or more and 30% or less. An experimental result has revealed that if the degree of crystallization is less than 1%, fluidity of the toner stored within the developer container 12*a* is liable to be lost. That is, the powder toners tend to clump together and to form macro-lumps, thus dropping the blocking property thereof.

The compatibility of the binder resin and the thermoplastic elastomer of the toner used in the present embodiment is controlled. A glass transition temperature Tg as the toner is preferable to be 20° C. or more and 60° C. or less. If the glass transition temperature Tg is less than 20° C., the blocking property becomes insufficient and if the temperature is more than 60° C., low-temperature fixability is lowered.

It is possible to determine the compatibility of the binder resin and the thermoplastic elastomer from a result of measurement of the glass transition temperature Tg by means of a DSC (differential scanning calorimeter). It is because the glass transition temperature Tg of the binder resin does not change and the glass transition temperatures Tg of the binder resin and of the thermoplastic elastomer are independently detected when no compatibility occurs. The glass transition temperature (Tg) is a physical property measured in accordance with JIS K7121 and means an intermediate point glass transition temperature described in the Standard.

(Binder Resin)

In order to be compatible with the thermoplastic elastomer, the glass transition temperature Tg of the binder resin is increased more than that of normal toner and is preferable to be 60° C. or more, or is more preferable to be 65° C. or more and 80° C. or less. Because the glass transition temperature Tg of the thermoplastic elastomer is less than room temperature and the glass transition temperature Tg of the binder resin drops when the thermoplastic elastomer is made compatible with the binder resin, the blocking property drops if the glass transition temperature Tg of the binder resin is less than 60° C.

Experimental results have revealed that a softening temperature Tm of the binder resin is preferable to be 70° C. or more and 110° C. or less, is more preferable to be 80° C. or more and 110° C. or less, and is most preferable to be 80° C. or more and 100° C. or less. If the softening temperature Tm of the binder resin is less than 70° C., the blocking property drops and the toner image releasing property (offset resistance) drops even if the toner contains release agent. Still further, if the softening temperature Tm of the binder resin is less than 70° C., a toner melt component in fixing the image permeates remarkably into tissues of the recording medium and surface smoothness of the image is liable to be damaged. Meanwhile, if the softening temperature Tm of the binder resin is 110° C. or more, fixability of the image drops.

The softening temperature Tm of the binder resin can be measured by using a flow tester (CFT-500D: manufactured by Shimadzu Corporation). Specifically, the measurement was carried out by weighing 1.2 g of specimen to be measured and by using a die whose height is 1.0 mm and whose diameter is 1.0 mm under conditions of 4.0° C./min of rate of temperature rise, 300 seconds of preheating time, 5 kg of load, and 60 to 200° C. of temperature measuring range. A temperature at which a half of the specimen flows out is defined to the softening temperature.

The binder resin is preferable to contain an ionizable group such as a sulfonic acid group and an amino group within its resin skeleton, and is more preferable to contain a carboxylic acid group. An acid value of the binder resin is preferable to be 3 to 35 mg KOH/g, and is more preferable to be 8 to 25 mg KOH/g. When the acid value of the binder resin exceeds 35 mg KOH/g, charge-up tends to be remarkable in a low humidity environment. Meanwhile, if the acid value of the binder resin is less than 3 mg KOH/g, electrification characteristic drops, so that it is improper to use as toner.

It is noted that the acid value is a total amount by mg (weight) of potassium hydroxide (KOH) required to neutralize free fatty acid, resin acid and others contained in 1 g of specimen. Its measuring method is carried out in accordance with JIS-K0070.

(Thermoplastic Elastomer)

The thermoplastic elastomer can be used an arbitrary thermoplastic elastomer as long as it is compatible with the binder resin described above and is crystalline. It is determined to have crystallinity if the thermoplastic elastomer has the degree of crystallization of 1% or more in the present embodiment. From an aspect of the blocking property, the degree of crystallization of the thermoplastic elastomer is preferable to be 10% or more and is more preferable to be 20% or more 60% or less.

While thermoplastic elastomers such as styrene-based thermoplastic elastomer, olefin-based thermoplastic elastomer, vinyl chloride-based thermoplastic elastomer, polybutadiene-based thermoplastic elastomer, and urethane-based thermoplastic elastomer can be used as the thermoplastic elastomer of the present embodiment, it is preferable to use the urethane-based thermoplastic elastomer from an aspect of control of a crystalline melting point. If polyester resin is used as the binder resin for example, it is preferable to use ester type urethane-based thermoplastic elastomer as the thermoplastic elastomer from the aspect of the compatibility with the polyester resin. A combination of the binder resin with the thermoplastic elastomer may be selected appropriately by considering the compatibility of the binder resin with the thermoplastic elastomer as described above.

Preferably, the softening temperature Tm of the thermoplastic elastomer is lower than the softening temperature Tm of the binder resin. If the softening temperature Tm of the thermoplastic elastomer is higher than that of the binder resin, only the binder resin within the toner melts first in the fixing process and bending resistance of the fixed item drops.

That is, the softening temperature Tm of the thermoplastic elastomer is more preferable to be 60° C. or more and less than the softening temperature Tm of the binder resin. If the softening temperature Tm of the thermoplastic elastomer is less than 60° C., the blocking property may become poor.

The content of the thermoplastic elastomer is preferable to be 20 pts.mass or more and less than 100 pts.mass, or is more preferable to be 30 pts.mass or more and 60 pts.mass or less with respect to 100 pts.mass of the binder resin. If the content of the thermoplastic elastomer is less than 20 pts.mass, elongation characteristic of the toner is not expressed and if the content of the thermoplastic elastomer exceeds 100 pts.mass, the blocking property becomes poor.

(Degree of Crystallization)

It is possible to determine whether or not the thermoplastic elastomer has the crystallinity by means of wide angle x-ray diffraction. The degree of crystallization was measured by the wide angle x-ray diffraction under the following conditions (a) to (g). That is, the degree of crystallization was calculated by separating an x-ray diffraction profile of the specimen into crystalline peaks and amorphous scattering from a result of the measurement of the wide angle x-ray diffraction and by measuring Ic (sum of areas of each crystalline peak) and Ia (sum of amorphous scattering areas) from the following equation:

$$\text{Degree of Crystallization}(\%)=Ic/(Ic+Ia)\times 100$$

(a) X-ray Diffractometer: manufactured by Bruker AXS, D8 ADVANCE (b) X-ray Source: Cu-Kα ray (monochromatized by a graphite monochrometer)

(c) Slit System: Slit DS, SS=1°, RS=0.2 mm (d) Output: 40 kV, 40 mA (e) Measurement Range: 20=5° to 60°

(f) Step Interval: 0.02°

(g) Scan Speed: 1°/min.

(Elongation Percentage)

Figure 4A:
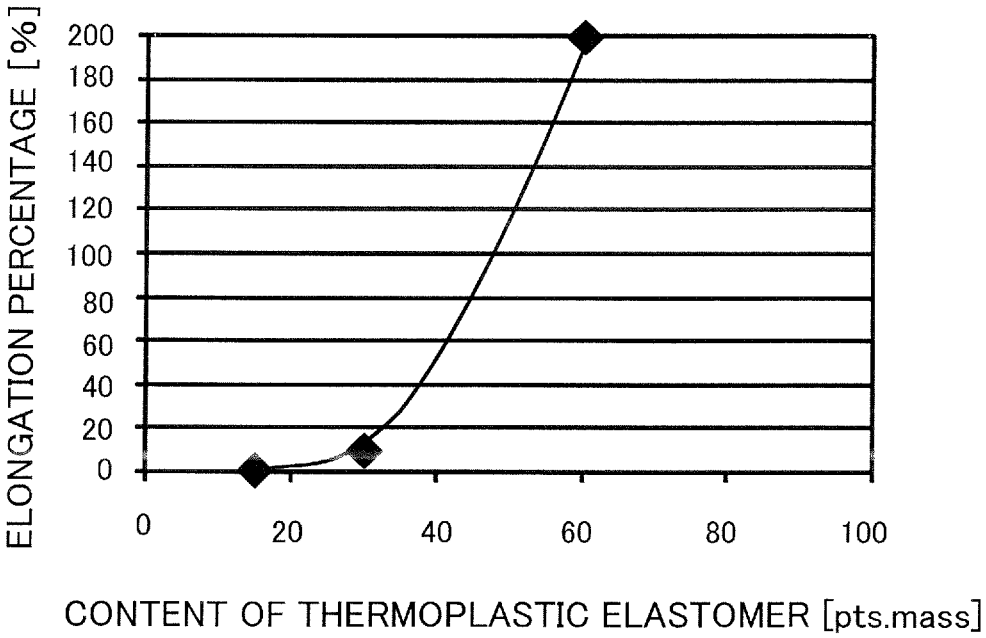
FIG. 4A is a graph illustrating a relationship between a content of thermoplastic elastomer and an elongation percentage of toner in which the content of the thermoplastic elastomer is up to 60 pts.mass.
Figure 4B:
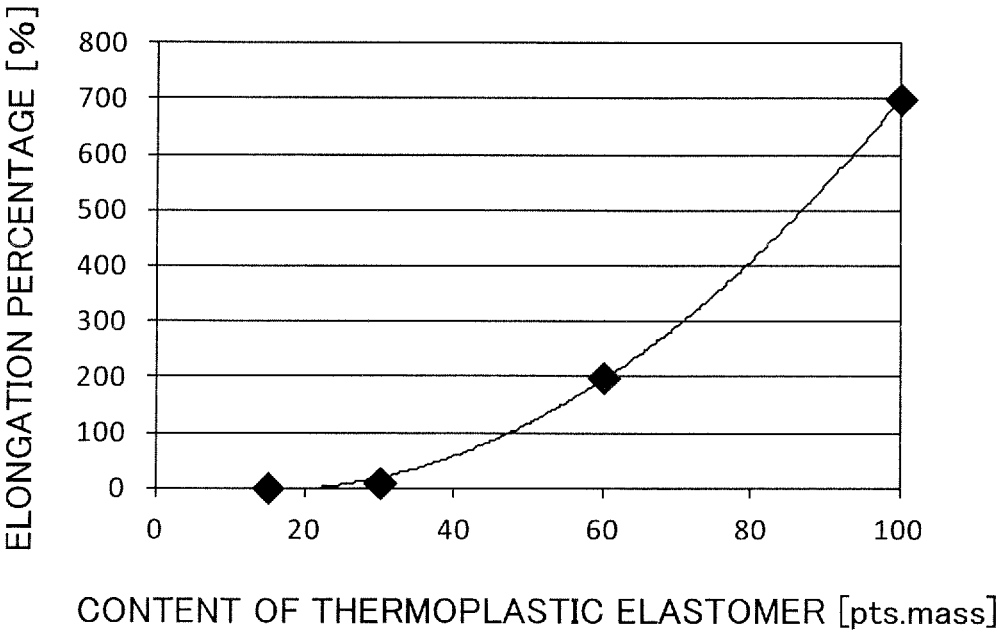
FIG. 4B is a graph illustrating a relationship between the content of the thermoplastic elastomer and the elongation percentage of toner in which the content of thermoplastic elastomer is up to 100 pts.mass.

FIGS. 4A and 4B are graphs illustrating a relationship between the content of the thermoplastic elastomer and an elongation percentage of the toner. As shown in FIGS. 4A and 4B, elongation characteristic starts to express and the elongation percentage sharply rises when the content of the thermoplastic elastomer of the toner increases to 20 pts.mass or more. The elongation percentage rises up to 200% when the content of the thermoplastic elastomer is 60 pts.mass.

The elongation percentage of the toner was measured by a tensile test. The toner was molded into a shape of a plate by hot pressing to prepare a test piece of 20 mm×2 mm×0.8 mm. One end of the test piece was fixed to a base, another end was fixed to a tensile unit movable in a certain axial direction, and the test piece was pulled with a speed of 50 mm/sec. The test piece breaks down when it is pulled by a certain pulling distance. The pulling distance by which the test piece breaks down is converted to be a rate to a length of the test piece before pulling the piece is defined as the elongation percentage of the toner.

The toner film is required to have an elongation characteristic far greater than that of a conventional toner film in order to assure film maintainability that causes no crack even if the toner film follows superficial ruggedness of the recording medium. The toner containing the thermoplastic elastomer has such enough elongation characteristic. While the elongation percentage of the toner changes depending on types and contents of the thermoplastic elastomer, it is desirable to cover a surface area of the recording medium having the ruggedness by the toner film in order to fully exhibit its effect. The toner film is desirable to have an elongation percentage more than what is equivalent to a ratio of an area of a rugged surface to an area of a smooth surface.

In other words, in order to follow the superficial ruggedness of the recording medium, the toner film is required to have an area elongation percentage of (sum total of areas of rugged surface under projected area)/(projected area). The elongation percentage of 200% shown in FIGS. 4A and 4B corresponds to an area elongation percentage of 400%, so that such a toner film can be expected to be able to fully coat even a considerably rugged recording medium.

The ratio of the area of the rugged surface to the area of the smooth surface (rate of rugged area) can be calculated by SX-Viewer which is analysis software dedicated for Micromap manufactured by Ryoka Systems Inc. from surface shape data measured by Micromap. For example, the percentage of rugged area of a commercially available recording medium is around 1.05 to 1.6, so that it is possible to obtain a minimal effect if a toner film has 5% to 60% of elongation percentage depending on types of a recording medium. The elongation percentage is preferable to be greater than the percentage of rugged area in order to obtain the favorable effect stably even if such disturbance factors as an impact on an image surface and environmental conditions occur. Considering also an error of the measured data of the surface shape, it is preferable to select the elongation percentage of 100% or more for example as the elongation percentage in which a potential of elongation is added further to a percentage of rugged area of a coarsest recording medium.

(Coloring Material)

The toner of the present embodiment contains one or more coloring materials as necessary to express yellow, magenta, cyan, and black. The coloring material may be a known organic pigment, oil dye, carbon black, magnetic powder, or the like. The coloring material is used solely or in mixture, or in a state of solid solution. The coloring material is selected from aspects of hue angle, chromaticness, brightness, light resistance, OHP transparency, and dispersibility to toner.

Contents of the coloring materials of yellow, magenta, cyan, and black is preferable to be 1 pts.mass or more and less than 20 pts.mass with respect to 100 pts.mass in total of the binder resin and the thermoplastic elastomer. If the content is less than 1 pts.mass, coloring may be insufficient. If the content exceeds 20 pts.mass, coloring material molecules coming out to a surface of a toner particle increase and possibly affect charging performance and others.

The cyan coloring material may be exemplified by a copper phthalocyanine compound and its derivative, an anthraquinone compound, a basic dye lake compound, and others. Specifically, the cyan coloring material may be C.I. pigment blue 1, C.I. pigment blue 7, C.I. pigment blue 15, C.I. pigment blue 15:1, C.I. pigment blue 15:2, C.I. pigment blue 15:3, C.I. pigment blue 15:4, C.I. pigment blue 60, C.I. pigment blue 62, C.I. pigment blue 66, and others.

The magenta coloring material may be exemplified by a condensed azo compound, a diketopyrrolopyrrole compound, an anthraquinone compound, a quinacridone compound, a basic dye lake compound, a naphthol compound, a benzimidazolone compound, a thioindigo compound, a perylene compound, and others. Specifically, the magenta coloring material may be C.I. pigment red 2, C.I. pigment red 3, C.I. pigment red 5, C.I. pigment red 6, C.I. pigment red 7, C.I. pigment violet 19, C.I. pigment red 23, C.I. pigment red 48:2, C.I. pigment red 48:3, C.I. pigment red 48:4, C.I. pigment red 57:1, C.I. pigment red 81:1, C.I. pigment red 122, C.I. pigment red 144, C.I. pigment red 146, C.I. pigment red 166, C.I. pigment red 169, C.I. pigment red 177, C.I. pigment red 184, C.I. pigment red 185, C.I. pigment red 202, C.I. pigment red 206, C.I. pigment red 220, C.I. pigment red 221, C.I. pigment red 254, and others.

The yellow coloring material may be exemplified compound and others typified by a condensed azo compound, an isoindolinone compound, an anthraquinone compound, an azo-metal complex, a methine compound, an arylamide compound and others. Specifically, the yellow coloring material may be C.I. pigment yellow 12, C.I. pigment yellow 13, C.I. pigment yellow 14, C.I. pigment yellow 15, C.I. pigment yellow 17, C.I. pigment yellow 62, C.I. pigment yellow 74, C.I. pigment yellow 83, C.I. pigment yellow 93, C.I. pigment yellow 94, C.I. pigment yellow 95, C.I. pigment yellow 97, C.I. pigment yellow 109, C.I. pigment yellow 110, C.I. pigment yellow 111, C.I. pigment yellow 120, C.I. pigment yellow 127, C.I. pigment yellow 128, C.I. pigment yellow 129, C.I. pigment yellow 147, C.I. pigment yellow 151, C.I. pigment yellow 154, C.I. pigment yellow 155, C.I. pigment yellow 168, C.I. pigment yellow 174, C.I. pigment yellow 175, C.I. pigment yellow 176, C.I. pigment yellow 180, C.I. pigment yellow 181, C.I. pigment yellow 191, C.I. pigment yellow 194, and others.

The black coloring material may be exemplified by carbon black, magnetic powder, or what is toned to black by using the yellow, magenta, and cyan coloring materials.

(Release Agent)

The toner of the present embodiment contains a release agent as necessary. The release agent is preferable to be one whose melting point is 150° C. or less, is more preferable to be one whose melting point is 40° C. or more and 130° C. or less, and is most preferable to be one whose melting point is 40° C. or more and 110° C. or less. Preferably, the release agent is used to be 10 pts.mass or more and 20 pts.mass or less with respect to 100 pts.mass in total of the binder resin and the thermoplastic elastomer.

The exemplary release agents include low molecular weight polyolefins such as polyethylene; silicons having a melting point (softening temperature) by heating; fatty acid amides such as oleic amide, erucic acid amide, ricinoleic acid amide, and stearic acid amide. The exemplary release agents also include ester waxes such as stearyl stearate; botanical wax such as carnauba wax, rice wax, candelilla wax, Japan tallow, jojoba oil; and animal waxes such as bees wax. The exemplary release agents also include mineral and oil waxes such as montan wax, ozocerite, ceresin, paraffin wax, microcrystallin wax, Fischer Tropsch wax, ester wax; and their modifications.

As described above, the combination of the soft transfer and fixing belt 21 with the toner particle containing the crystalline elastomer allows the toner film to be favorably transferred and fixed even to the recording medium whose superficial ruggedness is large. That is, because the elastic layer 21*b* of the transfer and fixing belt 21 is made to be softer than that of the conventional one, the toner film adheres to a bottom of concavities on the surface of the recording medium. Still further, because the toner whose elongation percentage is large is used, it is possible to prevent the toner film from cracking at the concavities on the surface of the recording medium. More specifically, because the toner film follows well to the superficial ruggedness of the recording medium in transferring and fixing the toner film integrated to the recording medium whose superficial ruggedness is large such as an uncoated sheet, rough sheet and recycled sheet, portions to which the toner film cannot be transferred hardly occur and the toner film integrated at parts corresponding to the concavities of the recording medium hardly cracks. The toner also comes into contact with the concavity of the recording medium, so that enough adhesion is brought about between the recording medium and the toner film. Due to that, it is possible to reduce a rupture of the toner film otherwise caused in transferring the toner film.

Because the toner film is transferred and fixed to the recording medium in the present embodiment, this system is advantageous in the following points as compared to the conventional system of fixing a powder toner image after electrostatically transferring it on a recording medium. Firstly, it is possible to reduce blurs and a fixing failure of an image that otherwise occur due to the powder toners that drop into concavities of the recording medium in electrostatically transferring the powder toner image on the recording medium. It is also possible to improve color reproducibility even in an image formed by reducing toner consumption because the toner film enables to keep a rate of covering a surface of a recording medium (contrast ratio) high. Transfer efficiency of an image transferred by means of the toner film is also higher than that transferred electrostatically.

Next, a method for manufacturing the toner described above will be explained below. As shown in FIG. 1, the developer container 12*a* stores toner particles and supplies the developer to the image forming apparatus 100. The toner particle of the present embodiment has a compositional structure manufactured by using an emulsion aggregation method. The glass transition temperature of the binder resin of the toner particle is 60° C. or more and less than 80° C. and the softening temperature of the binder resin is equal to or less than the softening temperature of the thermoplastic elastomer. The thermoplastic elastomer is contained in the toner particle by 20% or more and less than 100% to the binder resin. The binder resin and the thermoplastic elastomer are solid soluble with each other in the toner particle, and the solid soluble thermoplastic elastomer keeps the crystallinity of the thermoplastic elastomer before solid solubilized.

(Emulsion Aggregation Method)

Figure 5:
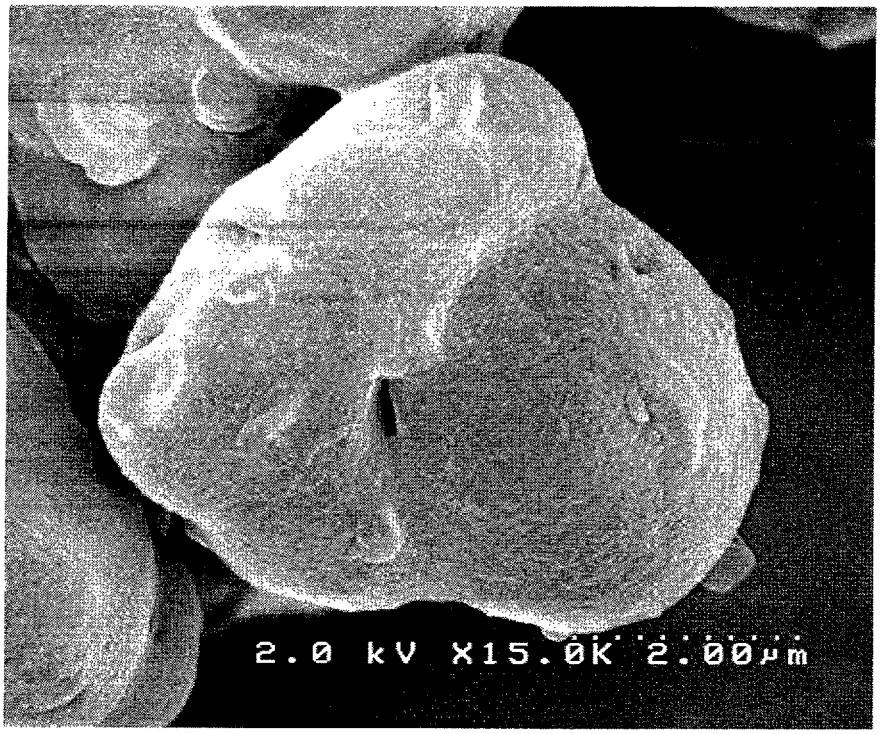
FIG. 5 is a micrograph showing an appearance of a toner particle of the first embodiment.

FIG. 5 is a micrograph showing an appearance of the toner particle of the present embodiment. The toner can be manufactured by using known manufacturing methods such as a kneading and grinding method, a dissolution suspension method, a suspension polymerization method, and the emulsion aggregation method. However, it is difficult to control the compatibility of the binder resin and the thermoplastic elastomer by the normal kneading and grinding method. Although the binder resin becomes compatible with the thermoplastic elastomer if the toner is kneaded while applying shear strongly, the crystallinity of the thermoplastic elastomer is lost and the blocking property becomes poor. If the strength of the shear is lowered, the binder resin and the thermoplastic elastomer become incompatible with each other and the elongation percentage of the toner drops.

As compared to that, the emulsion aggregation method permits to easily control the compatibility of the binder resin and the thermoplastic elastomer and to fully control the crystallinity of the thermoplastic elastomer as well. Due to that, the emulsion aggregation method is preferable as the manufacturing method of the toner used in the present embodiment.

The emulsion aggregation method is a method of manufacturing the toner particle by preparing a resin particulate which is fully smaller than a diameter of an objective particle in advance and by growing the particle by aggregating the resin particulates within an aqueous medium. The toner is manufactured by the emulsion aggregation method by undergoing a resin particulate emulsion process, an aggregation process, a fusion process, a cooling process, and a washing process.

It is noted that the appearance of the toner changes more or less because an external additive is applied on a surface of the toner (to endow electrification characteristics and fluidity) in actually forming an image. However, the toner manufactured by the emulsion aggregation method has no such fracture surface that is caused in the toner manufactured by the normal kneading and grinding method, and has a smooth and dull (porous) appearance (see FIG. 5) caused by that the particles are aggregated within the aqueous medium. Therefore, it is possible to estimate the manufacturing method by a certain degree by observing the toner particle manufactured by the emulsion aggregation method by an electron microscope. The method for manufacturing the toner by using the emulsion aggregation method will now be explained specifically.

(Emulsion Process)

The resin particulates of the binder resin and of the thermoplastic elastomer are prepared in advance. These powder resin particulates can be manufactured by a known method.

The resin particulates of the binder resin and of the thermoplastic elastomer are dissolved together in an organic solvent to form a homogeneous solution. Resin particulates containing the binder resin and the thermoplastic elastomer can be prepared by slowly adding the aqueous medium to the homogeneous solution and by precipitating resin. That is, particulates to be used in the emulsion aggregation method can be prepared by dissolving the binder resin and the thermoplastic elastomer in the organic solvent and by precipitating the resin by adding water. At this time, an organic solvent that forms a homogeneous phase with water is used as the organic solvent that dissolves the binder resin and the thermoplastic elastomer.

It is possible to form the resin organization in which the binder resin is compatible with the thermoplastic elastomer and the crystallinity of the thermoplastic elastomer is maintained by forming the particulates by such a method. It is considered that the compatibility is enhanced by dissolving the binder resin and the thermoplastic elastomer together and that the thermoplastic elastomer is crystallized by slowing precipitating the resin, even though its reason is not clear. As a result, it is considered to be able to manufacture the toner particles having the excellent blocking property and the large elongation percentage of the toner film.

Specifically, a surfactant and a base are added in dissolving the resin particulates of the binder resin and of the thermoplastic elastomer in the organic solvent. In succession, the aqueous medium is slowly added to the organic solvent while agitating by a homogenizer or the like to precipitate the resin particulates. After that, the solvent is removed by heating or vacuuming the resin particulates to prepare a resin particulate dispersion liquid.

It is noted that any organic solvent to be used to dissolve the binder resin and the thermoplastic elastomer can be used as long as it dissolves them. However, it is preferable to use a solvent that forms a homogeneous phase with water such as tetrahydrofuran from the aspect of controlling the compatibility of the resins.

The surfactant used in the emulsion process is not specifically limited, and may be an anionic surfactant such as a sulfate salt-base, sulfonate-base, carboxylate-base, phosphate ester-base, and soap-base anionic surfactant. It may be also a cationic surfactant such as an amine salt type and a quaternary ammonium salt type, and a nonionic surfactant such as polyethylene glycol-base, alkylphenol ethylene oxide adduct-base, and polyhydric alcohol-base surfactant. The surfactant may be used solely or two types or more of surfactants may be used in combination.

The base used in the emulsion process is not also specifically limited. The exemplary bases include an inorganic base such as sodium hydroxide and potassium hydroxide and an organic base such as triethylamine, trimethylamine, dimethylaminoethanol, and diethlaminoethanol. These bases may be used solely or in combination of two or more.

A volume-based median size of the resin particulate is preferable to be 0.05 to 1.0 μm or is more preferable to be 0.05 to 0.4 μm. It becomes difficult to obtain a toner particle of 4.0 to 7.0 μm which is an adequate volume-based median size if the resin particulate is 1.0 μm or more. It is possible to measure the volume-based median size by using a dynamic light-scattering type particle size distribution-measuring device (nano-track UPA-EX150: manufactured by Nikkiso Co., Ltd.).

(Aggregation Process)

In the aggregation process, a mixture is prepared by mixing coloring material particulates and release agent particulates as necessary with the resin particulates described above, and the particles contained in the prepared mixture are aggregated to form aggregates. A preferable exemplary method for forming the aggregates is to add and mix a coagulant with the mixture described above and to appropriately apply heat, mechanical power, and others.

The coloring material particulates used in the aggregate process are what the abovementioned coloring materials are dispersed. The coloring material particulates are dispersed by using a media type disperser such as a rotary shearing type homogenizer, a ball mill, a sand mill, and an Attritor, and a high pressure counter-collision type disperser. Other known disperse methods may be used. A surfactant and a polymeric dispersant that endow decentralized stabilization may be also added as necessary.

The release agent particulates used in the aggregate process are what the abovementioned release agent is dispersed within the aqueous medium. The release agent disperses with the various methods similarly to the coloring material particulates, and the surfactant and the polymeric dispersant may be added as necessary.

Exemplary coagulants used in the aggregate process include metal salt of univalent metal such as sodium and potassium, metal salt of bivalent metal such as calcium and magnesium, and metal salt of trivalent metal such as iron and aluminum.

It is preferable to add and mix the coagulant at temperature equal to or less than the glass transition temperature Tg of the resin particulates contained in the mixture. The aggregation advances stably if they are mixed under such temperature condition. The coagulant can be mixed with the mixture by using a known mixing unit, a homogenizer, and a mixer.

While an average particle size of the aggregate formed in the aggregation process is not specifically limited, the particle size is normally controlled to be 4.0 μm to 7.0 μm so that it is about a same level with an average particle size of the toner particles to be obtained. The control can be easily made by appropriately presetting and modifying the temperature in adding and mixing the coagulant and others and the conditions in agitating and mixing them for example. It is possible to measure a particle size distribution of the toner particles by a particle size distribution analyzer (Coulter Multi-sizer III: manufactured by Beckman Coulter, Inc.) using a Coulter method.

(Fusion Process)

A particle in which a surface of the aggregates described above is smoothed by heating and fusing the aggregates at the glass transition temperature Tg or more of the resin in the fusion process. In order to prevent the toner particles from fusing with each other before entering a primary fusion process, a chelating agent, a pH regulator, a surfactant or the like may be appropriately put in the process.

Exemplary chelating agents include alkali metal salt such as ethylenediaminetetraacetic acid (EDTA) and its Na salt or the like, sodium gluconate, sodium tartrate, potassium citrate, sodium citrate, and nitrotriacetate (NTA) salt. The exemplary chelating agents also include a large number of aqueous polymers (polyelectrolyte) containing both functionalities of COOH and OH.

The heating temperature described above may be a temperature between the glass transition temperature Tg of the binder resin contained in the aggregate and a temperature by which the binder resin thermally decomposes. The higher the heating temperature, the shorter a heating and fusing time is, and the lower the heating temperature, the longer the heating and fusing time is required. That is, while it is unable to indiscriminately define the heating and fusing time because it depends on the heating temperature, it is generally 10 minutes to 10 hours.

(Cooling Process)

A temperature of the aqueous medium containing the particles is cooled down to a temperature lower than the glass transition temperature Tg of a core resin in the cooling process. Unless the temperature of the aqueous medium is not cooled down to the temperature lower than the glass transition temperature Tg, coarse particles are generated. Specific cooling speed is 0.1 to 50° C./min.

(Washing and Drying Process)

It is possible to obtain the emulsified aggregate toner by washing, filtering and drying the particle prepared through the cooling process. After that, the toner is dried and nonorganic particles such as silica, alumina, titania, and calcium carbonate, or resin particles such as vinyl resin, polyester resin, and silicon resin may be added while applying a shearing force in the dried condition. These nonorganic particles and the resin particles function as external additive of a fluidity assistant or a cleaning assistant.

(Shelling Process)

A shelling process may be carried out between the fusion process and the washing and drying process as necessary for the toner used in the present embodiment. It is possible to improve the blocking property of the toner by making it hard to fuse among the particles by making core shell toners by adding the shelling process and by covering the toner particles by the shells whose glass transition temperature is high. That is, the shelling process is a process of shelling the particles prepared in the abovementioned processes by adding and attaching resin particulates anew. The binder resin particulates added here may be of a same structure with the binder resin particulates used in the core or may be binder resin particulates of a different structure.

The resin composing such a shell layer is not specifically limited, and a known resin used for the toner such as vinyl polymer, e.g., polyester resin and styrene-acryl copolymer, epoxy resin, polycarbonate resin, polyurethane resin or the like may be used. Among them, the polyester resin and the styrene-acryl copolymer are preferable, and the polyester resin is more preferable from an aspect of fixability and durability. The polyester resin has flexibility as compared to the vinyl polymer such as the styrene-acryl copolymer in case when it has a rigid aromatic ring within its main chain, so that it can give equal mechanical strength even if its molecular weight is lower than that of the vinyl polymer. Due to that, the polyester resin is preferable as a resin suitable for low-temperature fixability. The resin composing the shell layer may be used solely or a combination of two types or more may be used.

The toner particle of the present embodiment has the appearance peculiar to the emulsified aggregate method as shown in FIG. 5.

<Comparison of Relationships Between Toner and Recording Medium>

Next, results obtained by evaluating image transferability, fixability and film maintainability by using pluralities of toners and recording media in the image forming apparatus 100 will be explained.

Specifically, the film transferring process is carried out by using two types of recording media α and β having different coarseness to evaluate the transferability, fixability and film maintainability. The recording medium α is a fine sheet whose surface roughness is relatively small. The recording medium β is a bond sheet whose surface roughness is large. Toner A contains the thermoplastic elastomer of the present embodiment. Toner B is a commercially available copier toner containing no thermoplastic elastomer, prepared for comparison, and having a fusion point close to that of the Toner A. The evaluation was carried out under a condition in which the transferability is best in each toner in terms of the temperature condition in transferring the film by changing the toner film temperature before entering the film transferring nip portion and the temperature of the recording medium. An influence of the temperature condition in transferring the film will be described later.

TABLE 1

| RECORDING MEDIUM | SURFACE ROUGHNESS [μm] | TRANSFERABILITY | FIXABILITY | FILM MAINTAINABILIT |
|---|---|---|---|---|
| | | TONER A | | |
| α | 1.86 | ○ | ○ | ○ |
| β | 5.06 | ○ | ○ | ○ |
| | | TONER B | | |
| α | 1.86 | ○ | ○ | X |
| β | 5.06 | ○ | X | X |

The surface roughness Sa of the recording medium was measured by using Micromap manufactured by Ryoka Systems Co., Ltd. The surface roughness Sa indicates an arithmetic mean height and is a value defined as what absolute values of deviations from a mean level to surfaces of an image within an evaluation area are summed and averaged. The evaluation area of the surface roughness Sa was decided to be 1.23 mm×1.30 mm.

The transfer and fixing belt 21 whose value of surface hardness measured by a MD-1 hardness meter described later was 80.1 was used. This value is substantially the same level with surface hardness of a fixing roller used in an ordinary roller heating type fixing apparatus.

The transferability was evaluated visually, and cases when no toner film is left on the transfer and fixing belt 21 and is all transferred to a recording medium after passing the film transferring nip portion are marked as '○' and cases when even a part of the toner film is left on the transfer and fixing belt 21 are marked as 'x'.

The fixability was evaluated by carrying out a bending test on a part of the recording medium to which the toner film was transferred, and cases when a percentage of separation is less than 10% are marked as '○', cases when the percentage is 10% or more and less than 20% are marked as 'Δ', and cases when the percentage is 20% or more are marked as 'x'. The bending test was carried out by bending the output image crosswise while applying a load of 1 kg, by scrubbing the image by a lens-cleaning sheet on which a load of 200 g is applied by reciprocating it by five times, and by calculating a percentage of toner separation (surface ratio) after the test with respect to that before the test.

The film maintainability was evaluated by marking as '○' when the toner film is maintained without being cracked, and as 'x' when the toner film is cracked in the part of the recording medium on which the toner film was transferred.

As shown in Table 1, the transferability, fixability and film maintainability of the Toner A are all evaluated to be '○' on a recording medium α whose surface roughness is small. Meanwhile, although the transferability and fixability of the Toner B are evaluated to be '○', the film maintainability thereof is evaluated to be 'x'. The difference of the evaluations caused by the types of the toners is caused by that the Toner A has elongation characteristics as described later.

Next, while the transferability, fixability and film maintainability of the toner A are all evaluated to be '○' on a recording medium β whose surface roughness is large, it is difficult to achieve both the fixability and film maintainability of the toner B even though the transferability thereof is evaluated to be '○'.

Figure 6A:
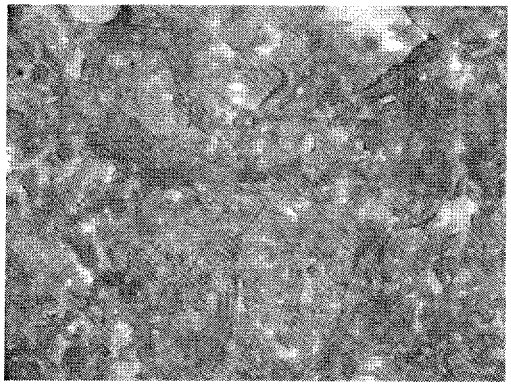
FIG. 6A is a micrograph of a surface condition of a recording medium on which film maintainability is evaluated to be poor.

When the film maintainability was evaluated to be 'x' after transferring an image of a maximum toner loading amount to the recording medium, the toner film was observed by an optical microscope of 500 magnifications as seen in a micrograph in FIG. 6A. In the photograph, whitish parts are parts where the toner film is broken and the base recording medium is exposed.

Figure 6B:
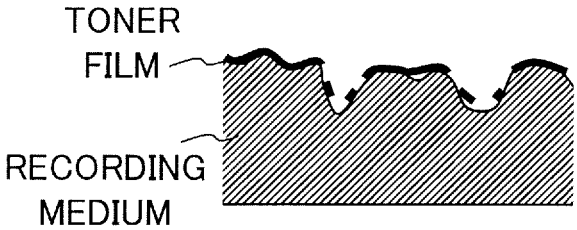
FIG. 6B is a schematic section view of the surface condition of the recording medium on which the film maintainability is evaluated to be poor.

FIG. 6B is a schematic diagram illustrating the ruggedness of the recording medium and the parts where the toner film is broken after measuring the surface shape of the image shown in FIG. 6A. As seen from FIG. 6B, the toner film is broken remarkably at positions corresponding mainly to concavities of the recording medium.

It can be seen from the above results that when the Toner B, i.e., conventional toner, is used, the film maintainability thereof is poor, and when the fixability and film maintainability thereof become poor on the recording medium whose surface roughness is large in particular. It can be also seen that when the Toner A, i.e., the toner of the present embodiment, is used, the toner A brings about an advantageous effect of improving the fixability and film maintainability, and the effect is remarkable on the recording medium whose surface roughness is large in particular.

<Comparison of Relationships Between Transfer Fixing Belt and Toner>

Next, a relationship between the transfer and fixing belt 21 and the toner of the present embodiment will be explained in detail.

Because the transfer and fixing belt 21 is a member that forms and transfers the film by applying heat and pressure as shown in FIG. 3, the transfer and fixing belt 21 is supposed to have basic characteristics, such as heat resistance, releasability, and durability, required to the conventional heating and pressurizing type fixing member. In addition to that, it is necessary to select peculiar surface hardness so that the transfer and fixing belt 21 can follow superficial ruggedness of a recording medium. Then, an explanation will be made below on results of tests conducted in the image forming apparatus 100 and obtained by comparing and studying a relationship between the surface hardness of the transfer and fixing belt 21 and the film transferring process conducted by changing the surface hardness of the transfer and fixing belt 21 and types of the toners.

Figure 7A:
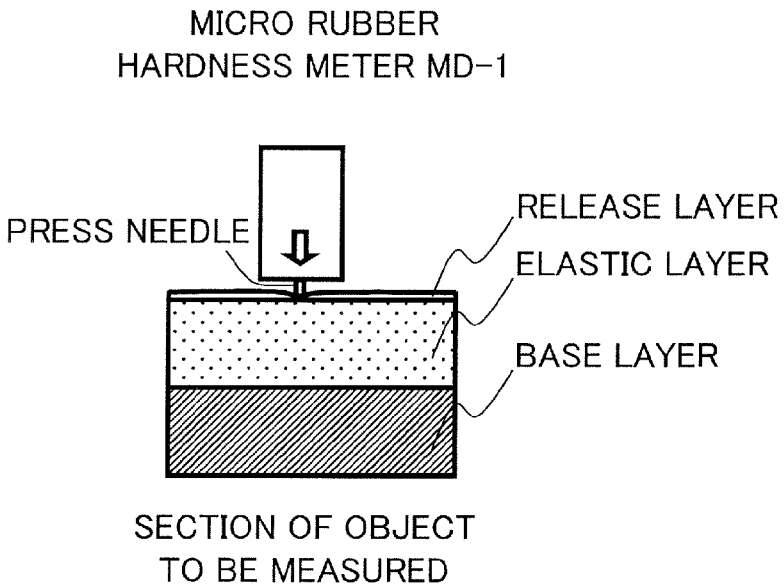
FIG. 7A is a schematic section view in measuring hardness of a surface layer of a member to be measured by using a MD-1 hardness meter.
Figure 7B:
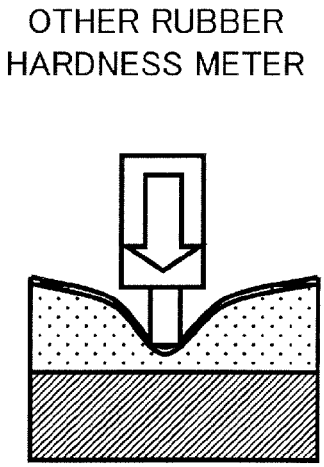
FIG. 7B is a schematic section view in measuring hardness of the surface layer of the member to be measured by using another rubber hardness meter.

The surface hardness of the transfer and fixing belt 21 was measured by using a Micro Rubber Hardness Meter MD-1 Type C (denoted as MD-1 hardness meter hereinafter) manufactured by Kobunshi Keiki Co., Ltd. The transfer and fixing belts b1, b2 and b3 were evaluated by using the MD-1 hardness meter due to the following reason. That is, it is assumed that there exist an elastic layer such as silicon rubber on a base layer made of metal and resin and a release layer such as PFA and PTFE as an outermost superficial layer as members to be measured. As shown in FIG. 7A, the MD-1 hardness meter permits to obtain hardness only in a vicinity of a surface of the measuring object because a press needle to be pushed into the measuring object is small and measures the hardness with a slight entry amount. Meanwhile, because another rubber hardness meter has a press needle larger than that of the MD-1 hardness meter and an entry amount to the measuring object is large as shown in FIG. 7B, the measurement is affected by an under layer material of the measuring object.

For instance, in a case when the elastic layer is very soft as compared to the release layer, i.e., the superficial layer, and the press needle enters such that the press needle largely deforms the elastic layer, the other rubber hardness meter tends to output a value smaller than the hardness in the vicinity of the superficial layer. When the press needle enters further, there is also a case when a value greater than the hardness in the vicinity of the superficial layer is output by being affected by the lowest base layer. Because the surface hardness of the transfer and fixing belt 21 contributes significantly to the effect of the film maintainability, the MD-1 hardness meter suitable for measuring the surface hardness was used.

TABLE 2

| TRANSFER AND FIXING BELT | SURFACE HARDNESS | TRANSFERABILITY | FIXABILITY | FILM MAINTAINABILIT |
|---|---|---|---|---|
| | | TONER A | | |
| b1 | 70.6 | ○ | ○ | ○ |
| b2 | 80.1 | ○ | ○ | ○ |
| b3 | 90.5 | X | X | X |
| | | TONER B | | |
| b1 | 70.6 | ○ | Δ | X |
| b2 | 80.1 | ○ | X | X |
| b3 | 90.5 | X | X | X |

The toner film was transferred by using the three transfer and fixing belts b1, b2 and b3 whose surface hardness are different from each other to evaluate the transferability, fixability, and film maintainability. The surface hardness of the transfer and fixing belts b1, b2 and b3 were changed by using different types of silicon rubber for the elastic layer of the transfer and fixing belt. The surface hardness of the transfer and fixing belt b2 measured by the MD-1 hardness meter was 80.1, so that it is the hardness of a conventional level. The surface hardness of the transfer and fixing belt b1 is 70.6, so that it was softer than the conventional level. The surface hardness of the transfer and fixing belt b3 was 90.5, so that it was harder than the conventional level. The transfer and fixing belt b2 is the same one with the transfer and fixing belt in Table 1 and is the exemplary transfer and fixing belt 21 of the present embodiment. It is noted that a surface hardness of the generally used roller heating and pressurizing type fixing roller was around 80 as measured by the MD-1 hardness meter.

A recording medium used here was the recording medium β whose surface roughness is large as described in connection with Table 1. The same Toners A and B as described in connection with Table 1 were used as toners. Temperature conditions in transferring the film were set in pursuit of the best transferability for the respective toners by changing temperature of the toner film before entering the film transferring nip portion and the temperature of the recording media in the same manner with the case when the relationship between the toner and the recording medium was compared. An influence of the temperature condition in transferring the film will be described later. The methods how to evaluate and how to view results of the transferability, fixability and film maintainability are the same with what described above.

As shown in Table 2, the evaluation items in the case of the transfer and fixing belt b3 whose surface hardness is high are all 'x' even if either one of the Toners A and B is used. While the evaluation items in the case of the transfer and fixing belt b2 whose surface hardness is the conventional level are all '○' when the toner A is used, the fixability and film maintainability are 'x', even though the transferability is '○', when the Toner B is used. The evaluation items in the case of the transfer and fixing belt b1 whose surface hardness is low are all '○' when the Toner A is used, the fixability is 'Δ' and the film maintainability is 'x', even though the transferability is '○', when the Toner B is used.

Accordingly, it can be seen that it is difficult to meet the standards of all of the evaluation items even if the surface hardness of the transfer and fixing belt 21 is changed when the Toner B is used.

FIGS. 8A, 8B, 9A and 9B schematically show the conditions of the toner films and the surface layers of the transfer and fixing belt passing through the film transferring nip portion based on the results of microscopic observations of the transferred and fixed films in the evaluation tests shown in Table 2.

Figure 8A:
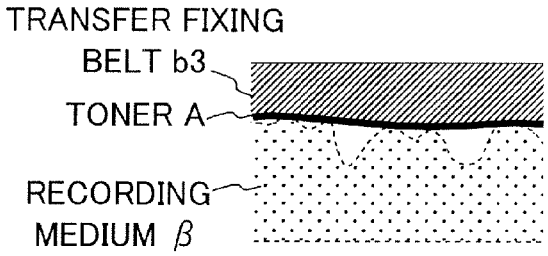
FIG. 8A is a schematic diagram illustrating a condition of a toner film transferred and fixed by a transfer and fixing belt whose surface hardness is high and by using Toner A.
Figure 8B:
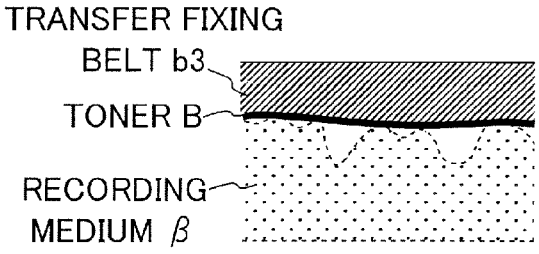
FIG. 8B is a schematic diagram illustrating a condition a toner film transferred and fixed by the transfer and fixing belt whose surface hardness is high and by using Toner B.

As shown in FIGS. 8A and 8B, in cases when the transfer and fixing belt b3 whose surface hardness is high is used, the surface of the transfer and fixing belt b3 cannot fully follow the superficial ruggedness of the recording medium β even in either case of FIG. 8A in which the Toner A is used and of FIG. 8B in which the Toner B is used. Therefore, the toner film tends to adhere only convex portions of the recording medium β and not to adhere concavities. This is considered to happen because it is unable to obtain enough adhesivity between the recording medium β and the toner film and the transferability and fixability become poor as a result. The toner film located at the concavities of the recording medium β is also considered to become inferior in terms of the film maintainability as such parts of the toner film are in a "bridged" state separating from the recording medium β and are easily broken by a slight impact because nothing supports such parts of the toner film after the transfer.

Figure 9A:
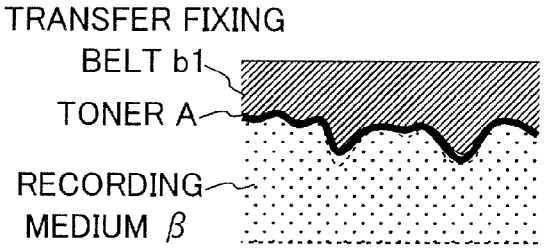
FIG. 9A is a schematic diagram illustrating a condition of a toner film transferred and fixed by a transfer and fixing belt whose surface hardness is low and by using the Toner A.
Figure 9B:
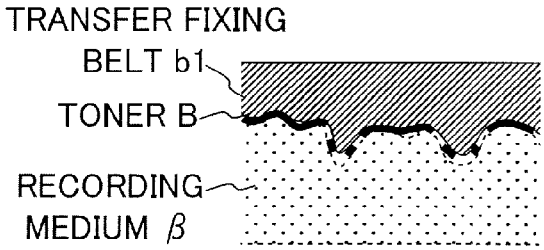
FIG. 9B is a schematic diagram illustrating a condition of a toner film transferred and fixed by the transfer and fixing belt whose surface hardness is low and by using the Toner B.

In the case of the transfer and fixing belt b1 whose surface hardness is low, the surface of the transfer and fixing belt b1 deforms following the superficial ruggedness of the recording medium β as shown in FIGS. 9A and 9B, so that the toner film adheres also to the concavities of the recording medium β, regardless of the Toners A and B. Because the toner film is in contact with the concave and convex portions of the recording medium β and adheres well to the recording medium β, there is no problem in terms of the transferability and fixability.

The toner film formed by the Toner A is considered that its crack is reduced and that it excels in the film maintainability because it has the elongation characteristic as the characteristic of the thermoplastic elastomer, and can deform along the shape of the superficial ruggedness of the recording medium β as shown in FIG. 9A.

In contrary, the toner film formed by the Toner B is considered that it causes cracks mainly at the concavities where the toner film is required to largely follow and deform as shown in FIG. 9B and is inferior in terms of the film maintainability because it is given no elongation characteristic and cannot elongate so as to coat the whole concavo-convex portions of the recording medium β.

As described above, the transfer and fixing belt whose surface hardness is considerably lower than that of the conventionally used fixing belt or the like is required in order to improve all of the transferability, fixability and film maintainability of the toner film to be used on the recording medium whose surface roughness is large. Accordingly, the surface hardness of the transfer and fixing belt is desirable to be less than 80 of the MD-1 hardness. The MD-1 hardness of a fixing belt having the conventional elastic layer is 80 or more. Meanwhile, although the lower the surface hardness of the transfer and fixing belt, the more the follow-up property thereof to the superficial ruggedness of a recording medium increases, durability thereof tends to drop in contrary. From the aspect of durability as the transfer and fixing unit, the surface hardness of the transfer and fixing belt is desirable to be 50 MD-1 hardness or more.

<Temperature Characteristics of Melt Viscosity of Toner>

Next, a relationship between the temperature and the transferability of the toner film in the film transfer portion 23 will be explained. Specifically, the transferability, fixability and film maintainability were evaluated by changing the toner film temperature before entering the film transferring nip portion N2. The same Toners A and B as described in connection with Table 1 were used. The recording medium β whose surface roughness is large as described in connection with Table 1 was also used. The transfer and fixing belt b1 whose surface hardness is lower than that of the conventional belt and described in connection with Table 2 was used as the transfer and fixing belt 21.

TABLE 3

| TONER FILM TEMPERATURE [° C.] | TRANS-FERABILITY | FIXABILITY | FILM MAINTAINABILIT |
|---|---|---|---|
| TONER A | | | |
| 25 | X | NOT ADHERED | NOT ADHERED |
| 60 | X | NOT ADHERED | NOT ADHERED |
| 75 | ○ | ○ | ○ |
| 90 | ○ | ○ | ○ |
| 100 | ○ | ○ | ○ |
| 120 | X | X | X |
| TONER B | | | |
| 25 | X | NOT ADHERED | NOT ADHERED |
| 60 | X | NOT ADHERED | NOT ADHERED |
| 75 | ○ | X | X |
| 90 | ○ | X | X |
| 100 | ○ | Δ | X |
| 120 | X | Δ | X |

The toner film temperature was changed in the following manner. That is, after forming the toner film in the film forming portion 22 shown in FIG. 3, the transfer and fixing belt 21 was temporarily stopped to naturally cool down the toner film and was driven again at timing when the temperature of the toner film reaches a predetermined temperature. The methods how to evaluate and how to view results of the image transferability, fixability and film maintainability are the same with the contents explained in connection with Table 1, so that an explanation thereof will be omitted here.

As shown in Table 3, all of the transferability, fixability and film maintainability was favorable when the film temperature was from 75° C. to 100° C. by the Toner A. When the film temperature was 25° C. (room temperature) and 60° C., i.e., lower than the temperature range described above, it was in a level of being barely unable to transfer an image and unable to evaluate fixability and film maintainability. When the film temperature was 120° C., i.e., higher than the temperature range described above, the transferability, fixability and film maintainability became poor.

Meanwhile, it was unable to find any favorable condition in all of the transferability, fixability and film maintainability by the Toner B. When the film temperature was 25° C. (room temperature) and 60° C., it was in a level of being barely unable to transfer an image and unable to evaluate fixability and film maintainability similarly to the case of using the Toner A. Although the transferability was favorable when the film temperature was from 75° C. to 100° C., the fixability and film maintainability became poor. When the film temperature was 120° C., the transferability became poor.

Figure 10:
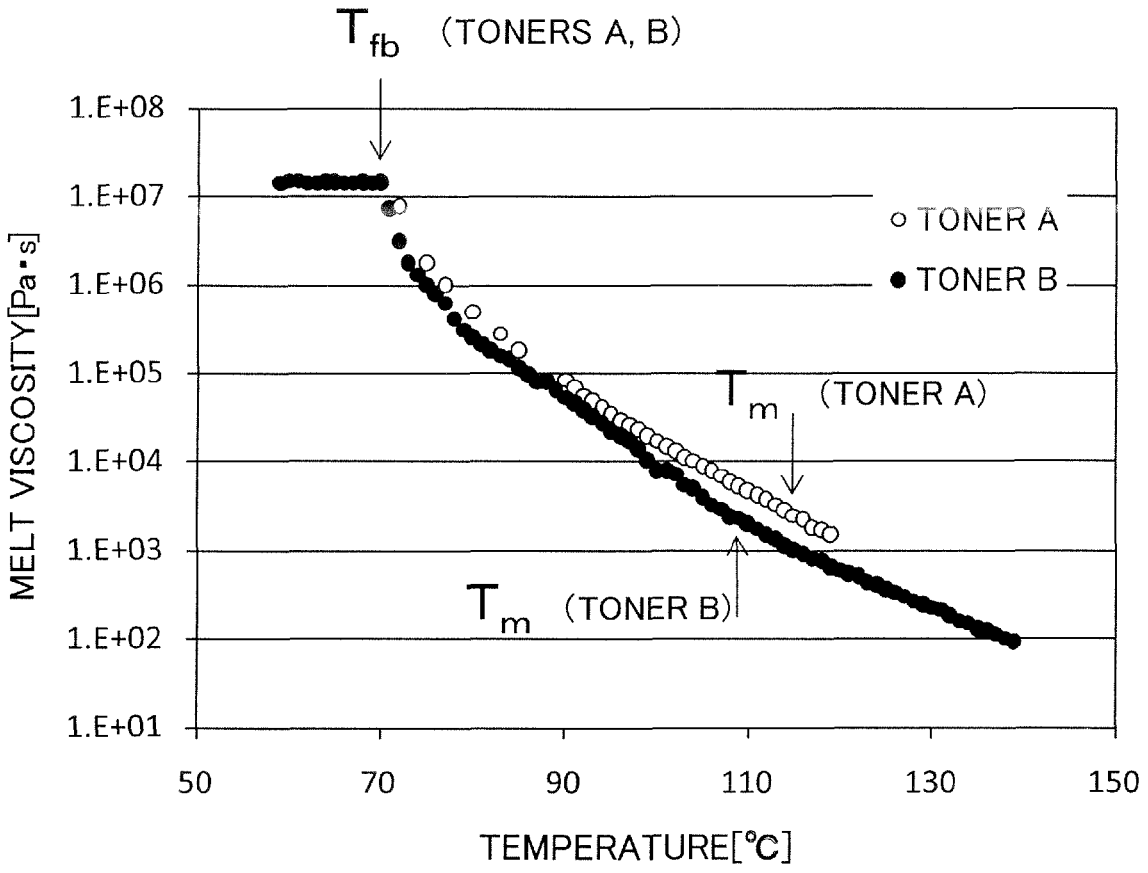
FIG. 10 is a graph illustrating temperature characteristics of melt viscosity of the Toners A and B.

As shown in Table 3, a reason why the transferability becomes poor in the low temperature condition in the both cases of the Toners A and B is a lack of adhesiveness of the toner films. As shown in FIG. 10, a temperature (flow starting temperature $T_{fb}$) from which viscosity of the both Toners A and B starts to drop in a melt step is about 70° C. The toners drop their viscosity at the flow starting temperature $T_{fb}$ or more and become adhesive. Accordingly, it is unable to obtain the adhesiveness required for the recording medium at the film temperature lower than the flow starting temperature $T_{fb}$, and hence the transferability becomes poor. The flow starting temperature $T_{fb}$ was measured by using a flow tester CFT-500D manufactured by Shimadzu Corporation. The measurement was carried out under a plurality of conditions in terms of loads and diameters of a die, and a lowest temperature from which a value of melt viscosity starts to sharply drop was adopted as the flow starting temperature $T_{fb}$. The flow starting temperature is an index measured by the flow tester and is different from the glass transition temperature. It is necessary to keep the toner film at the temperature higher than the 'flow starting temperature' in order to let the toner film have the adhesiveness in a level required for the transfer thereof (glass transition temperature Tg<flow starting temperature $T_{fb}$<softening temperature Tm).

It is necessary to configure and drive the transfer and fixing unit 20 such that the toner film temperature is adjusted by setting the flow starting temperature $T_{fb}$ of a toner to be used as a lower limit value in the image forming apparatus 100. For instance, it is necessary to properly set the heating temperature in the film forming portion 22, the driving speed of the transfer and fixing belt 21, a distance from the film forming portion 22 to the film transfer portion 23, and the like.

Figure 11A:
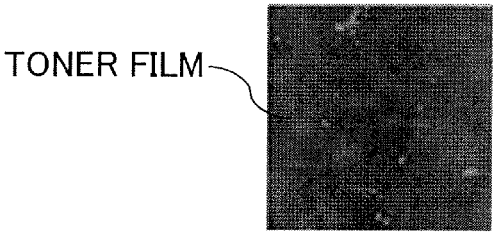
FIG. 11A is a photograph showing a condition of the toner film formed by the Toner A in a case of a high temperature condition of 100° C.
Figure 11B:
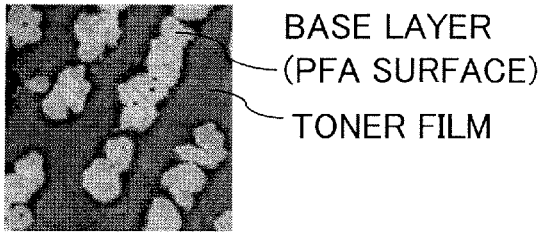
FIG. 11B is a photograph showing a condition of the toner film formed by the Toner A in a case of a high temperature condition of 120° C.

The transferability and film maintainability of the both Toners A and B become poor at 120° C., i.e., in the higher temperature condition, due to aggregation of the toner film. FIGS. 11A and 11B are photographs obtained by observing the aggregation of the toner film by holding the toner film formed by the Toner A on the transfer and fixing belt 21 for one second at two kinds of temperatures in a non-pressurized condition.

In a case of a high temperature condition of 100° C., a condition in which the non-fixed toner on the transfer and fixing belt 21 is melt and filmed is maintained in the film forming portion 22 as shown in FIG. 11A. A whole image area is substantially coated by the toner, though some gaps are left more or less.

In a case of a high temperature condition of 120° C., the condition in which the non-fixed toner on the transfer and fixing belt 21 is melt and filmed is not maintained in the film forming portion 22 as shown in FIG. 11B. The aggregation of the toner film occurs and an under layer (PFA here) which has been coated by the film is exposed again.

Accordingly, it is considered that the transferability and film maintainability became poor as the toner film was heated excessively and caused the aggregation of the toner film in the case of the high temperature condition of 120° C. Then, inventors of the present invention have found that the occurrence of the aggregation of the toner film is correlated with the softening temperature Tm of the toner. That is, the inventors have found that the film maintainability can be improved by adequately setting an upper limit value of the toner film temperature by the softening temperature Tm of the toner to be used.

As shown in FIG. 10, the softening temperature Tm of the Toner A is higher than the softening temperature Tm of the Toner B. Due to that, it is considered that the Toner A can assure the film maintainability even in the case of the high temperature condition of 100° C. as shown in Table 3.

It is noted that while the transferability, fixability and film maintainability are favorable by the Toner A in the toner film temperature of 75° C. to 100° C. as shown in Table 3, the film maintainability is particularly poor by the Toner B. A reason of this comes from the existence of the elongation characteristic of the toners and from the hardness of the transfer and fixing belt 21 as explained in the description about the relationship between the transfer and fixing belt and the toner. An explanation thereof will be omitted here to avoid repetitive explanations.

Second Embodiment

Figure 12:
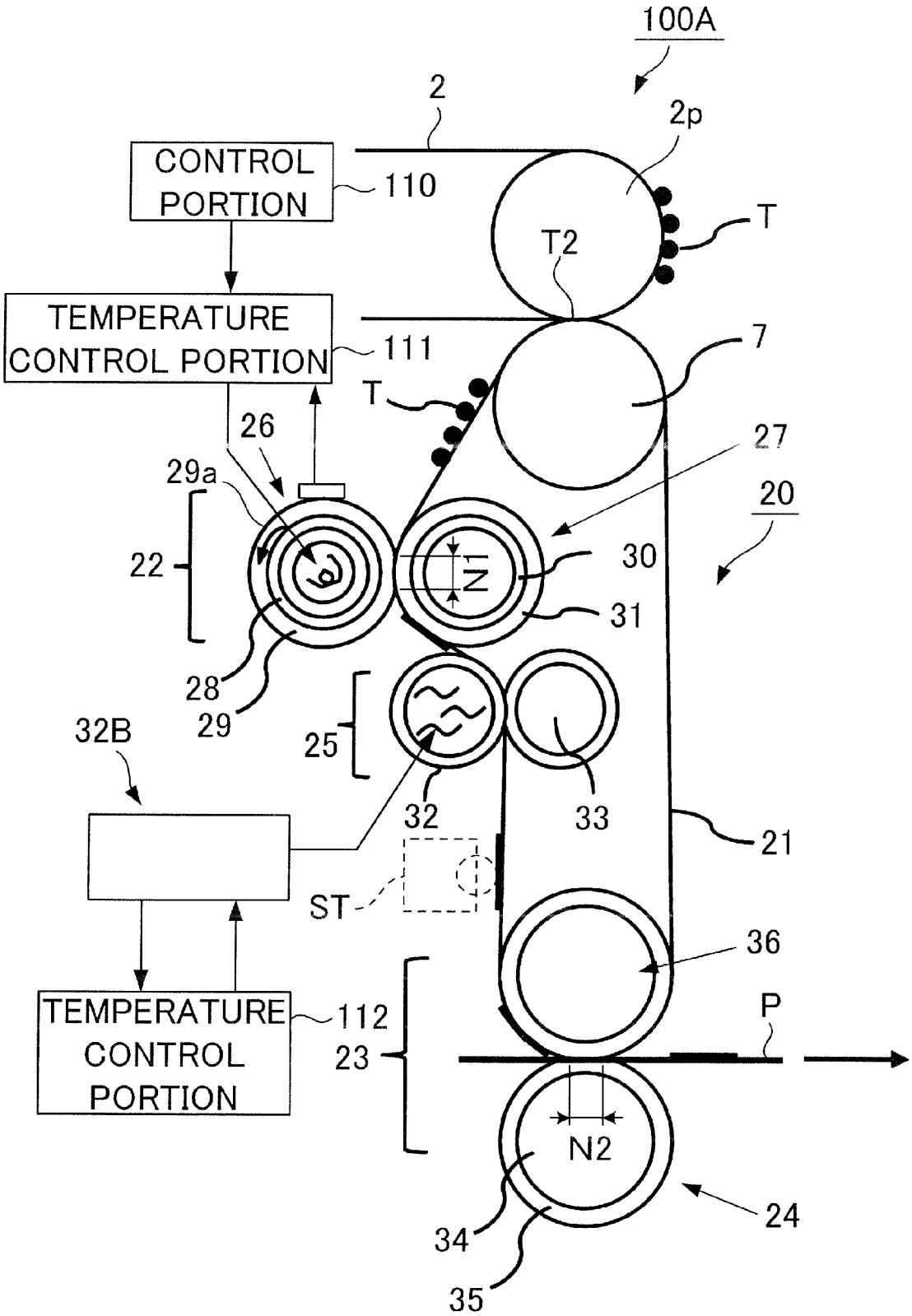
FIG. 12 is a schematic diagram illustrating a configuration of an image forming apparatus of a second embodiment.

Next, an image forming apparatus of a second embodiment of the invention will be explained. FIG. 12 illustrates a configuration of the image forming apparatus 100A of the second embodiment. As shown in FIG. 12, the image forming apparatus 100A is the same with the image forming apparatus 100 of the first embodiment except that a cooling unit 25 is added to the transfer and fixing unit 20. Therefore, the configuration and parts in FIG. 12 common with those of the first embodiment will be denoted by the common or corresponding reference numerals and an overlapped explanation thereof will be omitted here. The explanation of the configuration of forming a toner image on the intermediate transfer belt 2 and of transferring it to the transfer and fixing belt 21 shown in FIG. 1 will be omitted here.

As shown in FIG. 12, the cooling unit 25 which is one exemplary cooling portion is configured to send the toner film formed on the transfer and fixing belt 21 at the film forming portion 22 to the film transfer portion 23 by cooling it down to temperature less than the softening temperature of the toner and equal to or more than the flow starting temperature in a pressurizing condition.

The cooling unit 25 is installed between downstream of the film forming portion 22 and the film transfer portion 23. The cooling unit 25 is composed of a cooling roller 32 and a cooling pressure roller 33 in pressure contact with each other through an intermediary of the transfer and fixing belt 21. A cylindrical roller made of aluminum of 25 mm in diameter was used as the cooling roller 32 in the present embodiment. Cooling water whose temperature is kept at about 80° C. is circulated within the cooling roller 32 from a chiller not shown. A fluororesin (PFA) of 20 μm thick is coated as a releasing layer on a surface of the aluminum cylinder. A roller similar to the film forming portion 22 is used for the cooling pressure roller 33.

The cooling unit 25 is provided to control the toner film in temperature conditions required for the transfer of the toner film after forming the toner film. As described above, the destruction of the toner film occurs due to the aggregation of the toner film if the toner film temperature exceeds the toner softening temperature Tm. The transferability becomes also poor as the toner film temperature drops below the flow starting temperature $T_{fb}$.

Because the toner film is formed by temporarily heating a toner image to the toner softening temperature Tm or more in the film forming portion 22, it is effective to quickly cool down to transferable temperature in order to prevent the aggregation of the toner. It is necessary to assure certain coolability of the cooling unit 25 and a certain cooling time in order to sufficiently cool down the toner film. The inventors have found from their study that it is possible to quickly cool down the toner film on the transfer and fixing belt 21 at the outlet of the film forming portion 22 if the cooling time is assured by around 100 msec. Then, in order to assure the cooling time of 100 msec., the transfer and fixing belt 21 is wrapped around the cooling roller 32 in the second embodiment. Specifically, the cooling time of 100 msec. was assured by wrapping the transfer and fixing belt 21 around the cooling roller 32 by 13.1 mm.

The cooling roller 32 whose temperature is constant is brought into direct contact with the surface of the toner film formed in the film forming portion 22 to quickly cool down while pressurizing the toner film in the second embodiment, so that the aggregation of toner hardly occurs. Still further, because the toner film on the transfer and fixing belt 21 is bent in a direction in which the toner film is compressed (in a direction in which toners adjoin with each other) by wrapping the transfer and fixing belt 21 around the cooling roller 32, it is also possible to obtain an advantageous effect of suppressing the aggregation of toners.

It is noted that it is possible to change the coolability of the cooling unit 25 by adjusting temperature of the cooling water, a diameter of the cooling roller 32, a wrap-around angle of the transfer and fixing belt 21, and the like. These parameters can be adequately set while considering the suppression of the aggregation of the toners and the assurance of the temperature required for the transfer of the toner film. A temperature control portion 112 controls a water heater 32B such that temperature sensed by a temperature sensor becomes a predetermined target temperature.

The toner film may be transferred to the recording medium by using a fixation assisting agent, an adhesive, a gluing agent, or the like without relying on the adhesiveness of the toner film. In this case, the cooling unit 25 sends the toner film formed on the transfer and fixing belt 21 at the film forming portion 22 to the film transfer portion 23 while cooling down to a temperature less than the glass transition temperature of the toner in the pressurized condition. An adhesive applying unit ST is disposed as indicated by a broken line in FIG. 12 to apply an adhesive to the toner film on the transfer and fixing belt 21, so that the toner film is pressurized and bonded in the film transfer portion 23. It is noted that it is also possible to arrange such that an organic solvent is applied to and dissolve the surface of the toner film and to evaporate the organic solvent by the heat of the roller or the like after pressurizing and bonding at the film transfer portion 23. That is, when the toner film and the recording medium are to be joined chemically by using the adhesive and organic solvent, the cooling unit 25 cools down the toner film to the temperature below the glass transition temperature of the toner in the pressurized condition.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-008982, filed on Jan. 22, 2013, which is hereby incorporated by reference herein in its entirety.

What is claimed is:

1. An image forming apparatus, comprising:

an intermediate transfer belt;

a toner containing a binder and a thermoplastic elastomer having crystallinity, the content of the thermoplastic elastomer being 30 pts.mass or more and 60 pts.mass or less with respect to 100 pts.mass of the binder;

a toner image forming portion configured to form a toner image on the intermediate transfer belt by using the toner;

a transfer and fixing belt having an elastic layer and to which the toner image formed on the intermediate transfer belt is transferred;

a pressurizing and heating portion configured to form a toner film by heating the toner image carried by the transfer and fixing belt to a temperature of a softening temperature or more of the toner in a pressurized condition; and a toner film transfer portion configured to press the toner film formed by the pressurizing and heating portion on the transfer and fixing belt together with a recording medium to transfer the toner film to the recording medium.

2. The image forming apparatus according to claim 1, wherein the MD-1 hardness of a surface of the transfer and fixing belt is in a range equal to or greater than 50 and less than 80.

3. The image forming apparatus according to claim 2, further comprising a cooling portion configured to cool down the toner film formed by the pressurizing and heating portion on the transfer and fixing belt to a temperature lower than the softening temperature and equal to or higher than a flow starting temperature of the toner in a pressurized condition and to send the cooled toner film to the toner film transfer portion.

4. The image forming apparatus according to claim 2, further comprising a cooling portion configured to cool down the toner film formed by the pressurizing and heating portion on the transfer and fixing belt below a glass transition temperature of the toner in a pressurized condition and to send the cooled toner film to the toner film transfer portion, wherein the toner film is adhered to the recording medium by a chemical method.

5. An image forming apparatus, comprising;

an intermediate transfer belt;

a toner containing a binder, and a thermosplastic elastomer, the content of the thermoplastic elastomer being 30 pts.mass or more and 60 pts.mass or less of a thermoplastic elastomer with respect to 100 pts.mass of the binder a toner image forming portion configured to form a toner image on the intermediate transfer belt by using the toner;

a transfer and fixing belt having an elastic layer and to which the toner image formed on the intermediate transfer belt is transferred, the transfer and fixing belt being formed such that the MD-1 hardness of a surface of the transfer and fixing belt is in a range equal to or greater than 50 and less than 80;

a pressurizing and heating portion configured to form a toner film by heating the toner image carried by the transfer and fixing belt in a pressurized condition; and a toner film transfer portion configured to press the toner film formed by the pressurizing and heating portion on the transfer and fixing belt together with a recording medium to transfer the toner film to the recording medium.

6. The image forming apparatus according to claim 5, wherein the thermoplastic elastomer has crystallinity.

7. An image forming method, comprising:

forming a toner image using by a toner containing a binder and a thermoplastic elastomer having crystallinity, the content of the thermoplastic elastomer being 30 pts.mass or more and 60 pts.mass or less with respect to 100 pts.mass of the binder;

transferring the toner image on a belt member with an MD-1 hardness of a surface in a range equal to or greater than 50 and less than 80;

forming a toner film by heating the toner image carried by the belt member; and pressing the toner film formed on the belt member together with a recording medium to transfer the toner film to a recording medium.

* * * * *